US007021108B2

(12) United States Patent
Bodwell

(10) Patent No.: US 7,021,108 B2
(45) Date of Patent: Apr. 4, 2006

(54) PUNCHING TOOL FOR CONNECTING DECKING PANELS TOGETHER

(75) Inventor: Patrick Bodwell, West Sacremento, CA (US)

(73) Assignee: Varco Pruden Technologies, Inc., Memphis, TN (US)

( * ) Notice: Subject to any disclaimer, the term of this patent is extended or adjusted under 35 U.S.C. 154(b) by 0 days.

(21) Appl. No.: 10/299,040

(22) Filed: Nov. 18, 2002

(65) Prior Publication Data

US 2004/0093925 A1 May 20, 2004

(51) Int. Cl.
*B21D 39/02* (2006.01)

(52) U.S. Cl. ..... 72/325; 72/453.16; 29/243.58; 29/566

(58) Field of Classification Search ..... 72/325, 72/324, 450, 409.01, 409.02, 409.11, 414, 72/453.16, 453.15; 29/243.5, 243.58, 566
See application file for complete search history.

(56) References Cited

U.S. PATENT DOCUMENTS

| | | | | | |
|---|---|---|---|---|---|
| 991,440 | A * | 5/1911 | Hanna | 74/106 |
| 1,743,209 | A * | 1/1930 | Groehn | 72/451 |
| 2,160,258 | A * | 5/1939 | Berliner | 72/325 |
| 3,411,339 | A * | 11/1968 | Brown | 72/325 |
| 3,624,876 | A * | 12/1971 | Irvin | 29/243.5 |
| 3,877,280 | A * | 4/1975 | Cornell | 72/325 |
| 3,877,286 | A * | 4/1975 | Fontaine et al. | 72/450 |
| 4,035,901 | A * | 7/1977 | Lux et al. | 29/243.5 |
| 4,375,161 | A * | 3/1983 | Braun et al. | 72/412 |
| 4,442,581 | A * | 4/1984 | Molnick | 29/243.5 |
| 4,531,397 | A | 7/1985 | Pratt | |
| 4,571,975 | A * | 2/1986 | Pawloski et al. | 72/325 |
| 6,070,449 | A * | 6/2000 | Vachon | 72/451 |
| 6,212,932 | B1 | 4/2001 | Parker | |
| 2001/0010168 | A1 | 8/2001 | Parker | |
| 2001/0039704 | A1 | 11/2001 | Parker | |

* cited by examiner

*Primary Examiner*—Daniel C. Crane
(74) *Attorney, Agent, or Firm*—Egbert Law Offices

(57) ABSTRACT

A crimping tool including a frame, a die fixedly and non-pivotally supported by the frame, a punch arm pivotally mounted on the frame, a mating die affixed to the punch arm, and an actuator interconnected to the punch arm for moving the mating die between a first position in which the mating die engages the die and a second position in which the mating die is spaced from the die. The mating die is a male die having a generally triangular cross section.

2 Claims, 8 Drawing Sheets

PUNCHING TOOL FOR CONNECTING DECKING PANELS TOGETHER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to tools for forming features in the joints of structural steel decking and roofing. More particularly, the present invention relates to pneumatic shears which form a stylized cut in the joints of structural steel decking for the purpose of interlocking the sections of steel decking together.

BACKGROUND OF THE INVENTION

In the construction of modern buildings, there is erected a steel skeleton. It is necessary to have floors in the building. The floors are generally concrete floors. Also, in other forms of construction, steel buildings will have steel roofing.

In the construction of buildings, the steel skeleton has steel beams. Steel forms are placed on the steel beams and also the supports for the floors. Then, freshly mixed concrete is poured onto the steel forms and is allowed to cure. In order to have concrete floors, it is necessary to definitely position the steel forms onto the beams and also onto the supports of the steel forms. Further, it is necessary to definitely position the steel forms with respect to each other. The steel forms are typically corrugated sheets of steel. On one side of the sheet of steel, there is an upright edge. On the other side of the sheet of steel, there is an envelope to receive the upright edge of the adjacent sheet of steel.

The steel forms are laid on the beams and on the supports for the steel forms so that the envelope of the first steel form receives the upright edge of the second steel form, and, likewise, the envelope of the second steel form receives the upright edge of the third steel form. This is repeated until there are sufficient steel forms on the beams and on the supports of the steel forms to receive the freshly mixed, uncured concrete.

The adjacent steel forms are bonded together. At the present time, the adjacent steel forms are manually bonded together by a manually operated crimping tool. The operator actuates the crimping tool and makes a dent in each side of the envelope of the steel form and also in the upright edge of the next adjacent steel form. The dent definitely positions the steel forms with respect to each other. Also, a welder may tack weld the steel form to the beam so as to definitely position the steel forms with respect to the beams. After the steel forms have been positioned on the beams and onto the supports for the steel forms, and also definitely positioned with respect to each other, uncured concrete can be poured onto the top of the steel forms. The weight of the uncured concrete assists in positioning the steel forms onto the beams. In time, the concrete cures and bonds to the steel forms so as to position the steel forms onto the beams.

As previously stated, the operator manually crimps the adjacent steel forms to each other. The operator can take a crimping tool and walk on the steel forms and crimp together the adjacent steel forms. The manual crimping of the adjacent steel forms is a slow process since the operator cannot rapidly operate the manual crimping tool. Further, in time, the operator tires after operating the manual crimping tool and slows down in his work.

A similar process is also involved with the formation of structural steel roofing. Unlike with structural steel flooring, there is no concrete poured onto the upper surface of the roofing. Since the roofing panels are joined together in the same manner as the decking panels, it is important that the joints are secured together so as to prevent one panel from lifting off the other. It is also important to prevent the panels from shifting laterally with respect to each other along the seam. In view of the inherent forces created by earthquakes or by wind there is a weakness associated with crimped joints. As a result, supplementary operations must be carried out so as to properly join the roofing sections together. These supplemental operations can include welding and screwing of the seam to the extent necessary to satisfy the shear strength requirements of the roofing. Ultimately, the roof sections must be joined together with sufficient integrity to prevent the panels from separating from each other or shifting laterally as a result of earthquakes or under the presence of high wind conditions.

In the past, various patents have issued with respect to such crimping tools. For example, U.S. Pat. No. 4,531,397, issued on Jul. 30, 1985 to R. Pratt, describes a crimping tool which is power operated. This crimping tool has two movable links. There is a stud on the lower end of one of the movable links and a recess on the lower end of the other movable link. A power-operated movable piston is operatively connected to a plunger. The plunger connects with suitable toggles and, in turn, the toggles connect with an appropriate movable link. The operator can control the application of power to the power-operated movable piston so as to move the piston and thereby move the plunger and thereby move the toggles and the associated two movable links. The dies located on the end of the crimping tool will provide a power-driven crimp to the adjoining sections of steel decking and roofing. Unfortunately, this device is only used for crimping the upward exposed "male" lip with the female inverted "U"-shaped lip. The seam is crimped at periodic intervals by this crimping tool.

U.S. Pat. No. 6,212,932, issued on Apr. 10, 2001, to J. R. Parker, describes a power-assisted combination shear used for forming structural louvers in the crimped seam of structural steel decking. This shear includes a frame supporting a pair of jaws which are opened and closed by means of an operator-controlled pneumatic cylinder. One jaw terminates in a blade while the other jaw has a corresponding die member. The blade and the die have undercut reliefs in the root portions, which permit the louver to be formed without breaking through to the edge of the seam. The louver comprises a sheared portion in the form of a bowed tab bridging a corresponding window formed in the seam by the shearing of the tab. The interference between the louver and window provides a substantial increase in the lateral resistance (shear strength) of the crimped seam. As such, the device is intended to eliminate the need to additionally weld or screw the seams of the steel decking. U.S. Publication No. 2001/0010168, published on Aug. 2, 2001, is closely related to U.S. Pat. No. 6,212,932, and describes a method of securing work pieces together through the unique configuration of the jaws of the power-assisted combination shear.

Similarly, U.S. Publication No. 2001/0039704, published on Nov. 15, 2001, describes an arrangement similar to that of the prior publication and U.S. Pat. No. 6,212,932. In particular, this patent shows the actual steel structure as having the arrangement of louvers connected in an overlying and interconnected relationship.

Unfortunately, there are many problems associated with the prior art patents to Parker and the prior art patent to Pratt. Fundamentally, whenever it is necessary to have two pivotable arms for the purpose of forming the crimp or the louvers, there is a great potential for misalignment of the arms. Each of the linkages associated with each of the pivotable arms must move in perfect coordination so as to achieve the proper operation. It is known that over time, the various bearings and connections between the linkage members can wear after repeated usage. As the tolerances change between the respective dies associated with the pair of pivotal arms, there is a strong possibility of misalignment between the dies. When a misalignment occurs, the effective seal between the deck sections and roofing sections can become compromised. Furthermore, the use of a pair of pivotable arms can require additional maintenance and repair. Often, the application of power will be more to one side of the leading die arrangement while less on the opposite side of the mating die arrangement. Once again, an insufficient and inappropriate cut louver or ineffective crimp, can occur. Additionally, in the case of the Parker patent, and the associated applications, the particular dies associated with forming the louver are unnecessarily complicated. Ultimately, if any of the surfaces associated with the die of the Parker patent should become worn or distorted with time, the louver will have an undesired configuration or may ineffectively join the sections of steel decking together. The Parker patent relies on a blade-type male die for the formation of the cuts into the female die. It is known that such arrangement can become dull with time and use.

It is an object of the present invention to provide a tool for forming a cut between adjacent sections of steel flooring, roofing and decking.

It is another object of the present invention to provide a tool which assures continual and proper alignment between the male and female dies associated with the tool.

It is another object of the present invention to provide a tool for forming the strong connection between adjacent sections of steel roofing, flooring and decking which forms a secure cut between the sections over repeated usage.

It is still a further object of the present invention to provide a tool which can provide multiple cuts on a single punching operation at the juncture between adjoining sections of steel flooring, roofing and decking.

It is a further object of the present invention to provide a punch tool which avoids the use of a pair of pivotable arms.

It is still a further object of the present invention to provide a punch tool which is easy to use, easy to operate, and relatively inexpensive.

These and other objects and advantages of the present invention will become apparent from a reading of the attached specification and appended claims.

BRIEF SUMMARY OF THE INVENTION

The present invention is a punching tool comprising a frame, a die fixedly and non-pivotally supported by the frame, a punch arm pivotally mounted on the frame, a mating die affixed to the punch arm, and an actuator interconnected to the punch arm. The punch arm is movable between a first position in which the mating die engages the die and a second position in which the mating die is spaced from the die. The actuator serves to move the mating die between the first and second positions.

In the present invention, a handle is connected to the frame and extends outwardly therefrom This handle includes a bar extending transversely to the frame. This bar has a gripping surface at one end and a handle member at an opposite end thereof.

In the present invention, the actuator includes a piston-and-cylinder assembly having a piston rod extending outwardly therefrom. This piston rod is interconnected to the punch arm. A source of pneumatic pressure is connected to the piston-and-cylinder assembly. A trigger is cooperative with the source of pneumatic pressure for selectively passing air from the source of pneumatic pressure to the piston-and-cylinder assembly so as to move the punch arm from the second position to the first position. The piston-and-cylinder assembly is affixed on one side of the frame. The piston rod has a longitudinal axis extending at an acute angle with respect to a longitudinal axis of the frame. The punch arm is connected to the piston rod on an opposite side of the frame from the piston-and-cylinder assembly. The piston rod is connected to the end of the punch arm by a clevis pivotally connected to an end of the punch arm opposite the mating die.

In the present invention, the tool has surfaces for holding inserts, such as a female die and a male die. Various shapes of dies can be on the surfaces of the tool. For example, these surfaces can support a traditional bottom punch. Alternatively, these surfaces can be flat so as to cause the flat crimping of the panels. However, in the preferred embodiment of the present invention, the male die has a generally triangular cross section. The female die has a generally inverted V-shaped configuration. The die includes a plurality of female dies arranged in spaced linear alignment and generally transverse to a longitudinal axis of the frame. The mating die includes a plurality of male dies arranged in spaced linear alignment in correspondence with the plurality of female dies. In use, the cooperation of these dies will create a "snakebite" cut in the adjoining sections of steel flooring, roofing and decking.

DETAILED DESCRIPTION OF THE INVENTION

Figure 1:
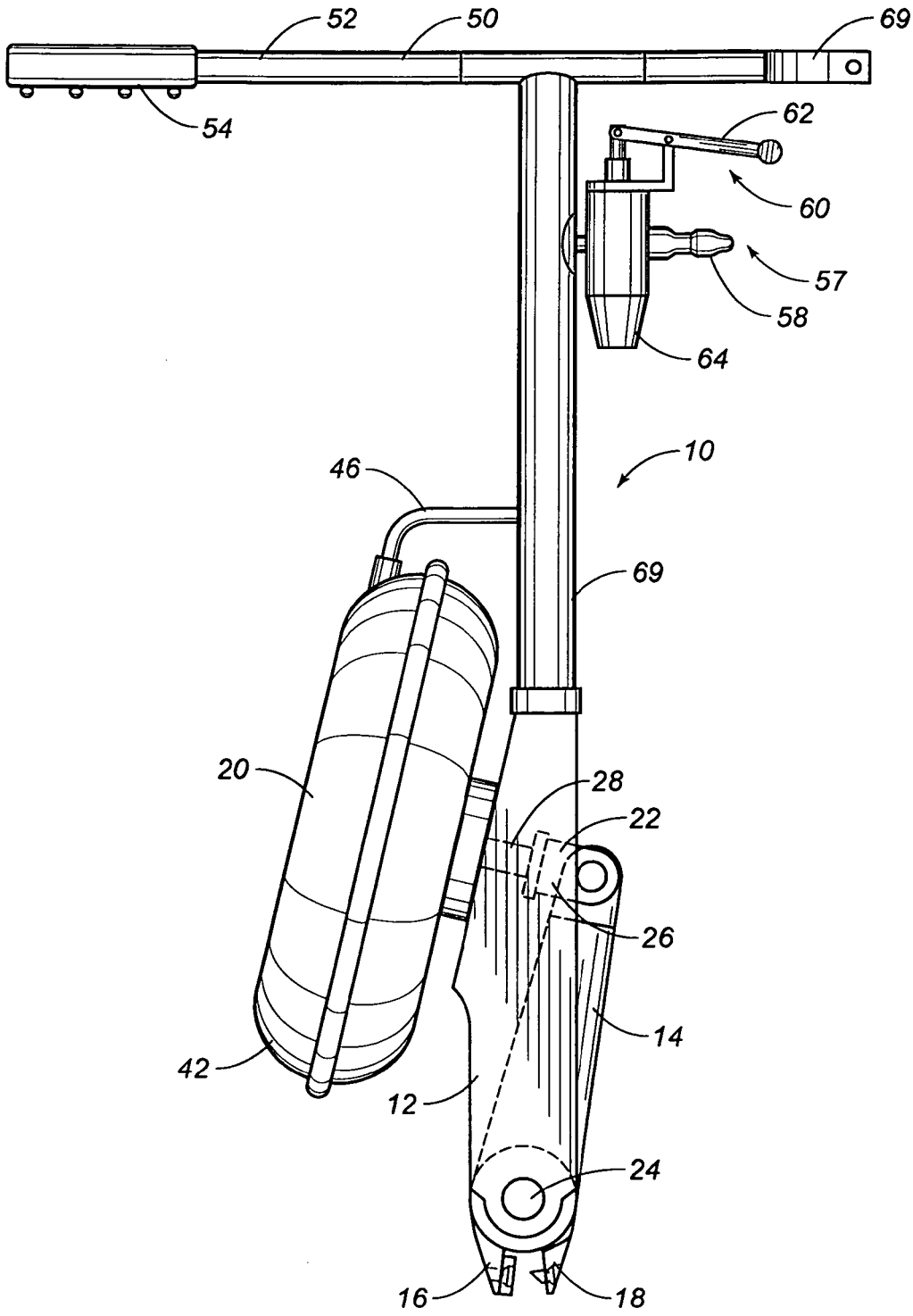
FIG. 1 is a side elevational view showing the punching tool of the present invention with the dies in their open position.

Referring to FIG. 1, there is shown the punch tool 10 in accordance with the preferred embodiment of the present invention. The punch tool 10 includes a frame 12, a punch arm 14 pivotally mounted on the frame 12, a die 16 fixedly and non-pivotally supported by frame 12, a mating die 18 affixed to the punch arm 14, and an actuator 20 interconnected to the punch arm 14 for moving the mating die 18 relative to the die 16. A linkage 22 is used so as to connect the actuator 20 to the punch arm 14.

As can be seen in FIG. 1, the die 16 is formed at the bottom end of the frame 12. The die 16 is aligned with the die 18 so that the dies 16 and 18 will suitably mate with each other when the punch arm 14 is pivoted about its pivotal connection 24 with the frame 12. The linkage 22 is a clevis connected between the actuator 20 and the punch arm 14 so as to suitably pivot the punch arm 14 between a first position in which the mating die 18 engages the die 16 and a second position, shown in FIG. 1, in which the mating die 18 is spaced from the die 16.

In FIG. 1, it can be seen that the die 16 is a female die and that the mating die 18 is a male die. When the punch arm 14 is moved into the first position, the male die 18 will enter the female die 16 so as to form the cut between the sections of steel decking. The particular configuration of the relationship of the dies 16 and 18 is shown in FIGS. 9–12, as will be described hereinafter.

Figure 5:
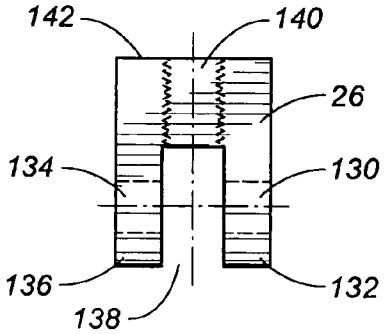
FIG. 5 is a detailed view of the clevis of the present invention.

The linkage 22 associated with the present invention serves to connect the actuator 20 with the punch arm 14. The linkage 22 includes, in particular, a clevis 26 (as shown in FIG. 5) connected to the actuator 20. In particular, the clevis 26 is suitably threadedly connected, or otherwise connected, to the piston rod 28 of the actuator 20.

In FIG. 1, it can be seen that the actuator 20 includes an air can 42 which is affixed to the frame 12. The air can 42 has a piston-and-cylinder arrangement therein (as shown in greater detail in FIG. 4). A piston rod 28 will extend outwardly from the air can 42 so as to be connected to the clevis 26. In particular, piston rod 28 will have a longitudinal axis which extends at an acute angle with respect to the frame 12. The air can 42 is mounted on one side of the frame 12. The piston rod 28 extends across the frame 12 so as to have an end connected to an opposite end of the punch arm 14 opposite the mating die 18. The piston rod 28 is connected to a piston supported interior of the cylinder of the air can 42. A spring, or other resilient member, is affixed within the air can 42 so as to urge the piston rod 28 toward the opposite side of the air can 42 from the frame 12 such that the punch arm 14 will assume the position shown in FIG. 1. An air supply line 46 is connected to the interior of the air can 42 so as to deliver air to one side of the piston located within the air can 42. Air supply line 46 communicates with a source of pneumatic pressure for the delivery of air thereinto.

A handle 50 is connected to the top end of the frame 12 so as to provide support for the frame 12. In particular, a vertical pipe 69 associated with handle 50 extends downwardly so as to be joined to frame 12. A sleeve 73 is welded to the top of the frame 12. The bottom end of pipe 69 is received within sleeve 73. A bolt or pin 75 can be extended through the wall of sleeve 73 so as to affixed the pipe in its proper position within the sleeve 73. Handle 50 is made up of a bar 52 which extends transversely to the frame 12. Bar 52 has a gripping portion 54 at one end thereof and a handle portion 56 at an interior end thereof. The handle portion 56 is further from to the frame 12 than the gripping portion 54. The gripping portion 56 should be suitably close to the trigger mechanism 60 so as to allow the operator to access the trigger mechanism 60 for the delivery of air pressure into the actuator 20 and for the proper use of the punch tool 10 of the present invention. During normal use, the gripping portion 58 and the handle portion 56 of handle 50 will be grasped by the worker for the manipulation of the opposite end of the punching tool 10 during the punching of the steel deck connections.

The actuator 20 of the present invention also includes a source of air pressure 57 which is connected to inlet 58 associated with the trigger mechanism 60. Trigger mechanism 60 includes a lever 62 suitably positioned close to the end of portion 56 of handle 50. As such, the lever 62 will be in a proper position for easy actuation by the worker using the handle 50. The lever 62 associated with the trigger mechanism 60 can be lifted so as to open the air valve 64 and allow air to pass through the inlet 58, through the air hose 46, into the air can 42. When the lever 62 is released, the spring action of the air valve 64 will return the lever 62 to its desired position.

In normal use, when the trigger mechanism 60 is actuated, air will flow through inlet 58 through the air hose 46 so as to create a pushing force on the piston within the air can 42. This, in turn, will move the piston rod 28, and the associated clevis 26, outwardly. As a result, the punch arm 14 will move angularly outwardly of the frame 12 so as to bring the male die 18 toward the female die 16. This will cause a punch of the adjoining deck sections located in the space between the male die 18 and the female die 16. When the trigger mechanism 60, and its associated lever 62, is released, the spring within the air can 42 will urge the piston upwardly within the air can 42. This will cause the piston rod 28, and the associated clevis 26, to move inwardly.

Within the concept of the present invention, the air can 42 can take a wide variety of configurations. For example, the air can 42 can be placed in other locations on the frame 12 while still achieving the same punching results. In particular, a variety of other linkages can be implemented so as to allow for the proper movement of the punch arm 14. As used herein, the term "actuator means" can also take on a wide variety of configurations. For example, it is possible for the actuator to actually work by having the air supply retract the piston within the air can 42. As a result, through suitable linkages, the male and females dies can move in an opposite orientation to that described in FIG. 1. Within the concept of the present invention, it is possible that hydraulics or electrics could be used in place of pneumatics associated with the actuator means. The actuator means can be placed in various locations associated with the handle 50 or with the frame 42. The actuator means shown in FIG. 1 is not intended to limit the broad scope associated with the concept of the present invention. Various other operable arrangements of the "actuator means" can be considered as within the scope of the present invention.

Figure 2:
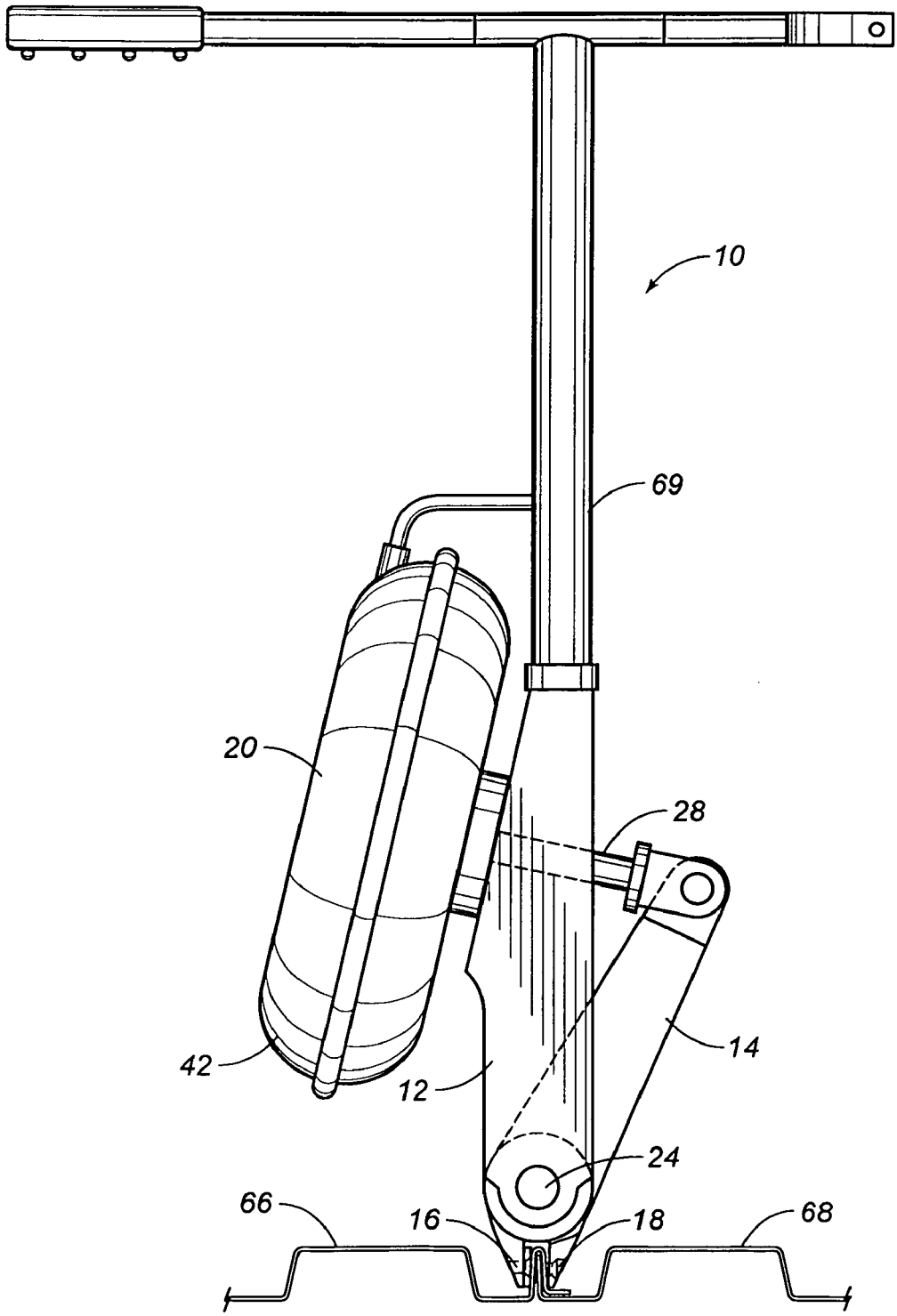
FIG. 2 is diagrammatic illustration of the present invention showing the dies in their closed position with respect to sections of metal decking.

FIG. 2 is an illustration of the punching tool 10 of the present invention as used for the joining of deck sections 66 and 68. It can be seen that the deck sections 66 and 68 will have an envelope portion and a lip portion sandwiched together within the space between the male die 18 and the female die 16 on the end of frame 12 of punch tool 10. The trigger mechanism 60 has been omitted from the illustration of FIG. 2. When the trigger mechanism is actuated, the actuator 20, and, in particular, the air can 42 is actuated so as to urge the piston rod 28 outwardly therefrom. As a result, the punch arm 14 will pivot about pivot point 24 so as to be at a greater angle relative to the longitudinal axis of the frame 12. As a result, the male die 18 will strongly move toward the female die 16 so as to carry out the requisite crimping and punching operation for the joining of deck sections 66 and 68 together.

Figure 3:
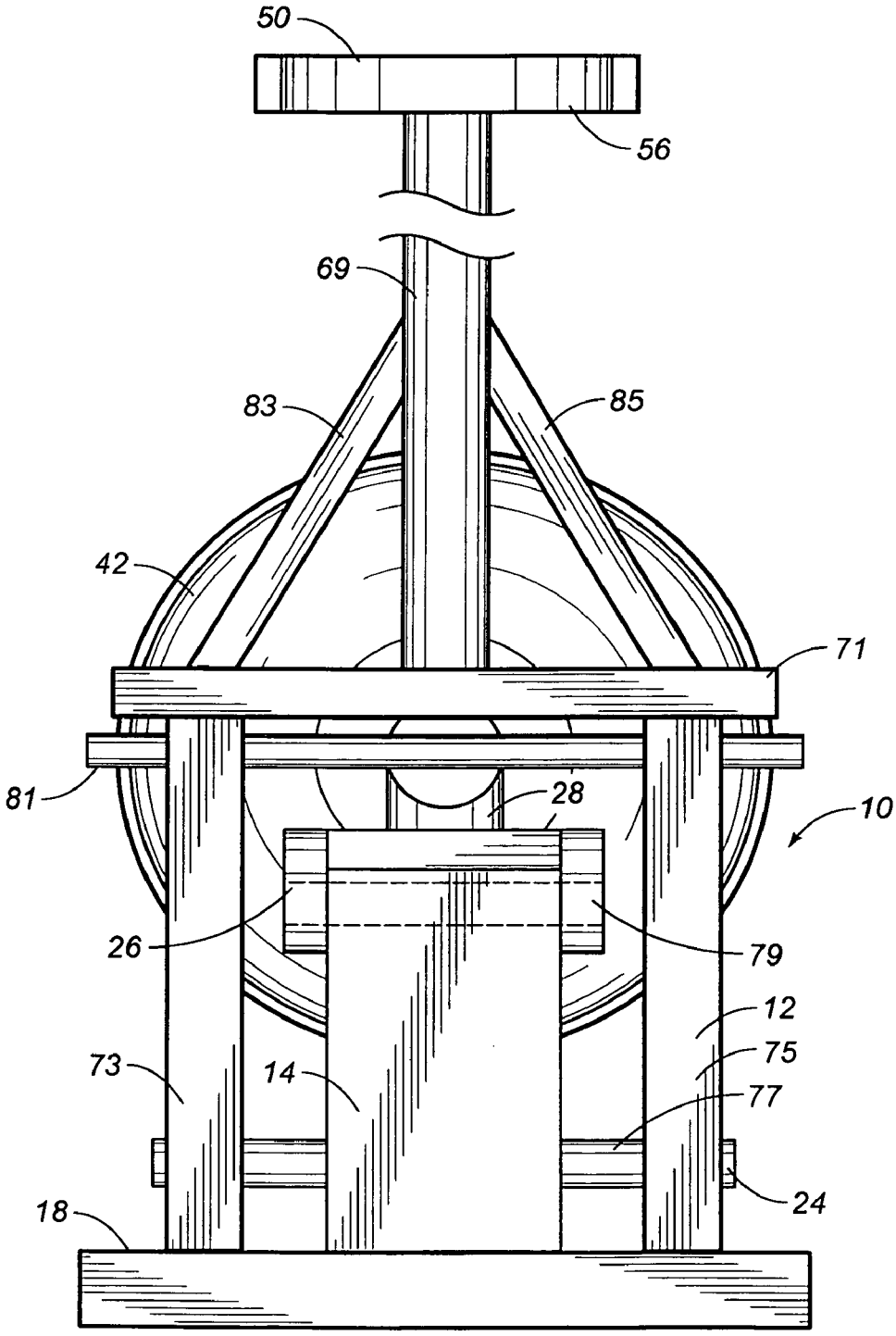
FIG. 3 is an end view of the punch tool of the present invention.

FIG. 3 shows an end view of the punch tool 10 of the present invention. In particular, in FIG. 3, it can be seen that the frame 12 has the pipe 69 an upper strut 69 extending upwardly from support sleeve 73. The sleeve 73 is welded to the support plate 71. The frame 12 also includes parallel and spaced apart lower support sections 74 and 76 extending downwardly to the male die 18. The male die 18 is shown as supported by punching arm 14. The punching arm 14 is pivotally mounted at 24 upon a shaft 77 extending between the support frame members 74 and 76. The punch arm 14 is also pivotally connected at 79 to the clevis 26 and, in turn, to the piston rod 28 extending outwardly from air can 42. The air can 42 is supported on a plate 81 rigidly affixed to the frame 12. The end of handle 50 is shown with the handle portion 56 particularly illustrated.

Figure 4:
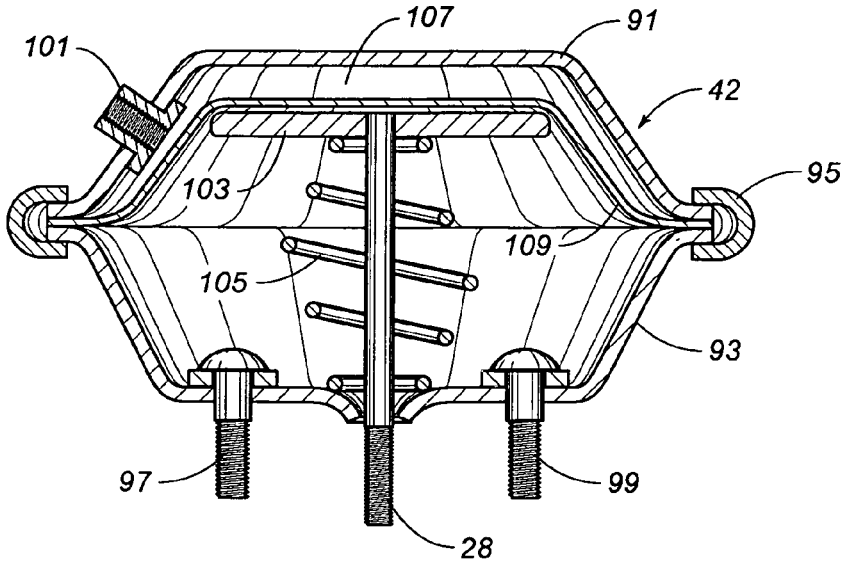
FIG. 4 is a cross-sectional view showing the piston-and-cylinder assembly used in the present invention.

FIG. 4 shows an illustration of the air can 42 associated with the present invention. Air can 42 is particularly made of upper cannister 91 and lower cannister 93 joined together by a clamping band 95 around the periphery thereof. Bolts 97 and 99 extend through the lower cannister 93 so as to allow the lower cannister 93 to be secured to the support plate 81 by conventional means. Piston rod 28 is illustrated as extending outwardly of the lower cannister 93. An air inlet/outlet 101 is formed through the upper cannister 91 so as to allow air from the air hose 46 to be introduced into the interior of the air can 42.

In FIG. 4, it can be seen that the piston rod 28 is connected interior of the air can 42 to a piston 103. A return spring 105 will extend through the interior of the air can 42 so as to bear against the underside of the piston 103 and against the inner wall of the lower cannister 93. As a result, the return spring 105 will urge the piston 103 into the position shown in FIG. 4. As a result, when air pressure is not applied within the air can 42, the spring 105 will return the piston 103 toward the inner wall of the upper cannister 91. A rubber diaphragm 109 has its outer edges secured by the clamping bands 95 in the periphery between the upper cannister 91 and the lower cannister 93. Rubber diaphragm 109 will bear against the upper surface of the piston 103 so as to define the space 107 within the interior of the air can 42. When air is introduced through the air inlet 101, the air will fill the space 107 such that the rubber diaphragm 109 will exert a force upon the piston 103. This will drive against the resisting force of the spring 105 so as to cause the piston rod 28 to extend outwardly into the position shown in FIG. 2 herein.

FIG. 5 shows an isolated view of the clevis 26. The clevis 26 has a pivot opening 130 formed in a first flange member 132 and a second pivot opening 134 formed in a second flexible member 136. A space 138 is formed between the flange members 132 and 136 so as to allow for the receipt of the upper end of the punch arm 14 therein. A suitable connector 140 is formed at the top end 142 of the clevis 26 so as to allow for the attachment of piston rod 28 therein.

Figure 6:
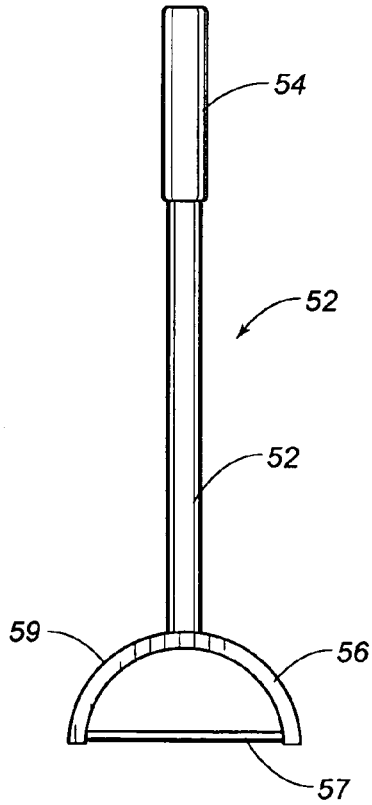
FIG. 6 is a plan view of the handle associated with the punch tool of the present invention.

FIG. 6 is an isolated view of the handle 50 as used on the frame of the present invention. Handle 50, as stated previously, has a gripping surface 54 formed at one end of the bar 52. Gripping surface 54 can be suitably rubber coated, knurled, or otherwise adapted so as to allow workers to easily grasp surface 54. The handle portion 56 is formed at the opposite end of the bar 52 from the gripping portion 54. Handle portion 56 is illustrated as having a generally C-shaped configuration. A crossbar 57 will extend between the ends of the C-shaped portion 59 so as to facilitate the grasping of the handle portion 56 and for the manipulation of the punch tool 10 of the present invention.

Figure 7:
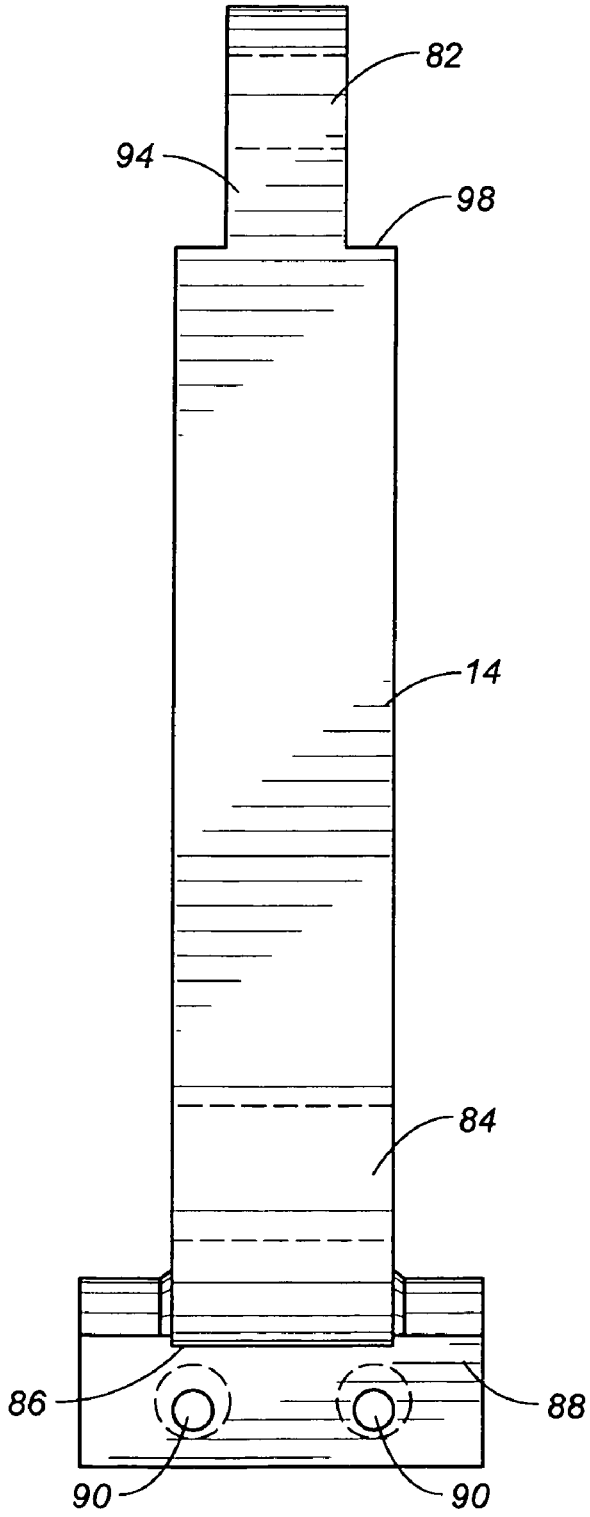
FIG. 7 is an end view showing the punch arm as used in the punch tool of the present invention.
Figure 8:
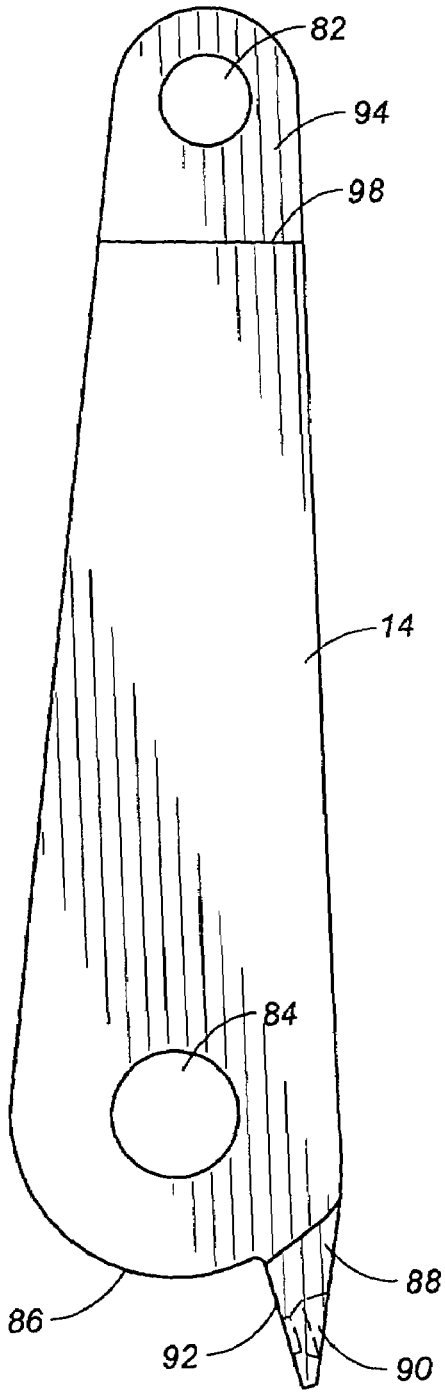
FIG. 8 is a side elevational view of the punch arm as used in the present invention.

FIGS. 7 and 8 show an isolated view of the punch arm 14 associated with the present invention. Punch arm 14 has a pivot opening 82 at a top end thereof. A suitable pin can be installed through the pivot opening 82 so as to join the pivot opening 82 with the pivot openings 130 and 134 of clevis 26. Another pivot opening 84 is formed adjacent to the bottom 86 of the punch arm 14. Pivot opening 84 will allow a pin to be inserted through the pivot point 24 of the frame 12 so as to allow for the pivotal mounting of the punch arm 14 within the sides 74 and 76 of the frame 12. A downwardly extending portion 88 extends from one side of the bottom 86 of the punch arm 14. A suitable support opening 90 is formed in this downwardly extending portion 88 so as to allow for the affixing of the male die 18 thereon. A surface 92 is formed on the downwardly extending portion 88 so as to face the downwardly extending portion associated with the frame 12.

The pivot opening 82 extends through flange 94 formed at the top 98 of the punch arm 14. The pivot opening 82 is formed so as to extend through the thickness of the flange 94. Downwardly extending arm 88 is formed at the bottom 86 of the punch arm 14. Support openings 90 are illustrated as extending through the thickness of the downwardly extending portion 88. As such, downwardly extending arm 88 forms a widened surface for supporting the male die 18 thereon.

Figure 9:
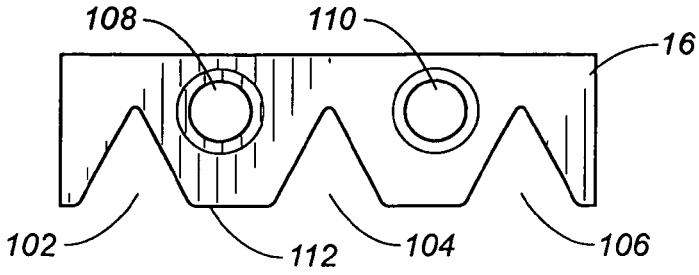
FIG. 9 is an isolated frontal view of the female die of the present invention.
Figure 10:
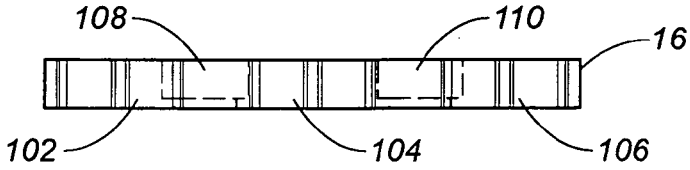
FIG. 10 is a plan view of the female die of the present invention.

FIG. 9 is an isolated view of the female die 16. The female die 16 includes a plurality of inverted V-shaped openings 102, 104 and 106. Threaded bolt openings 108 and 110 are provided through the female die 16 so as to allow for a joining with a support opening associated with the downwardly extending arm of the frame 12. The V-shaped openings 102, 104 and 106 have a bottom surface which opens to the bottom edge 112 of the female die 16. FIG. 10 shows a cross-sectional top view of the female die 16.

Figure 11:
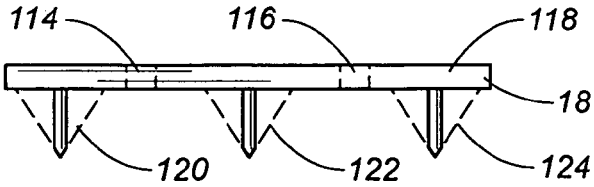
FIG. 11 is a plan view of the male die of the present invention.
Figure 12:
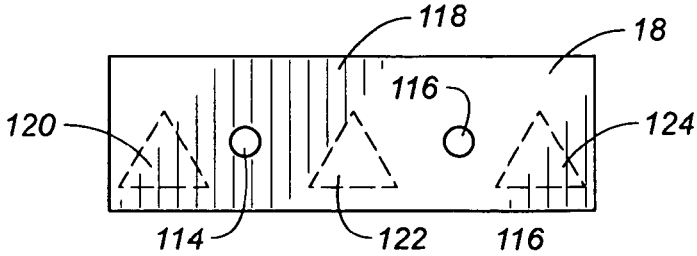
FIG. 12 is a frontal view of the male die of the present invention.

In FIG. 11, it can be seen that the male die 18 has a pair of threaded bolt holes 114 and 116 extending through the back surface 118 of the male die 18. The bolt holes 114 and 116 allow the male die 18 to be secured to the corresponding bolt openings 90 associated with the downwardly extending arm 88 of the punch arm 14. Importantly, male dies 120, 122 and 124 extend outwardly from the surface 118. Male dies have a generally pointed configuration so as to provide for a suitable puncturing and punching of the adjoining deck sections. Each of the male dies 120, 122 and 124 tapers from an outwardly extending point opposite to the surface 18 so as to widen toward the surface 118. In FIG. 12, it can be seen that the plurality of male dies 120, 122 and 124 have a generally triangular configuration suitable for mating with the inverted V-shaped die members 102, 104 and 106 of female die 16. Each of the male die members 120, 122 and 124 is spaced from each other in generally linear alignment along the backing surface 118. When the punch arm 14 is suitably pivoted about pivot point 24, the male die 18 will move toward the female die 16 and puncture the adjoining sections of steel decking therebetween.

Figure 13:
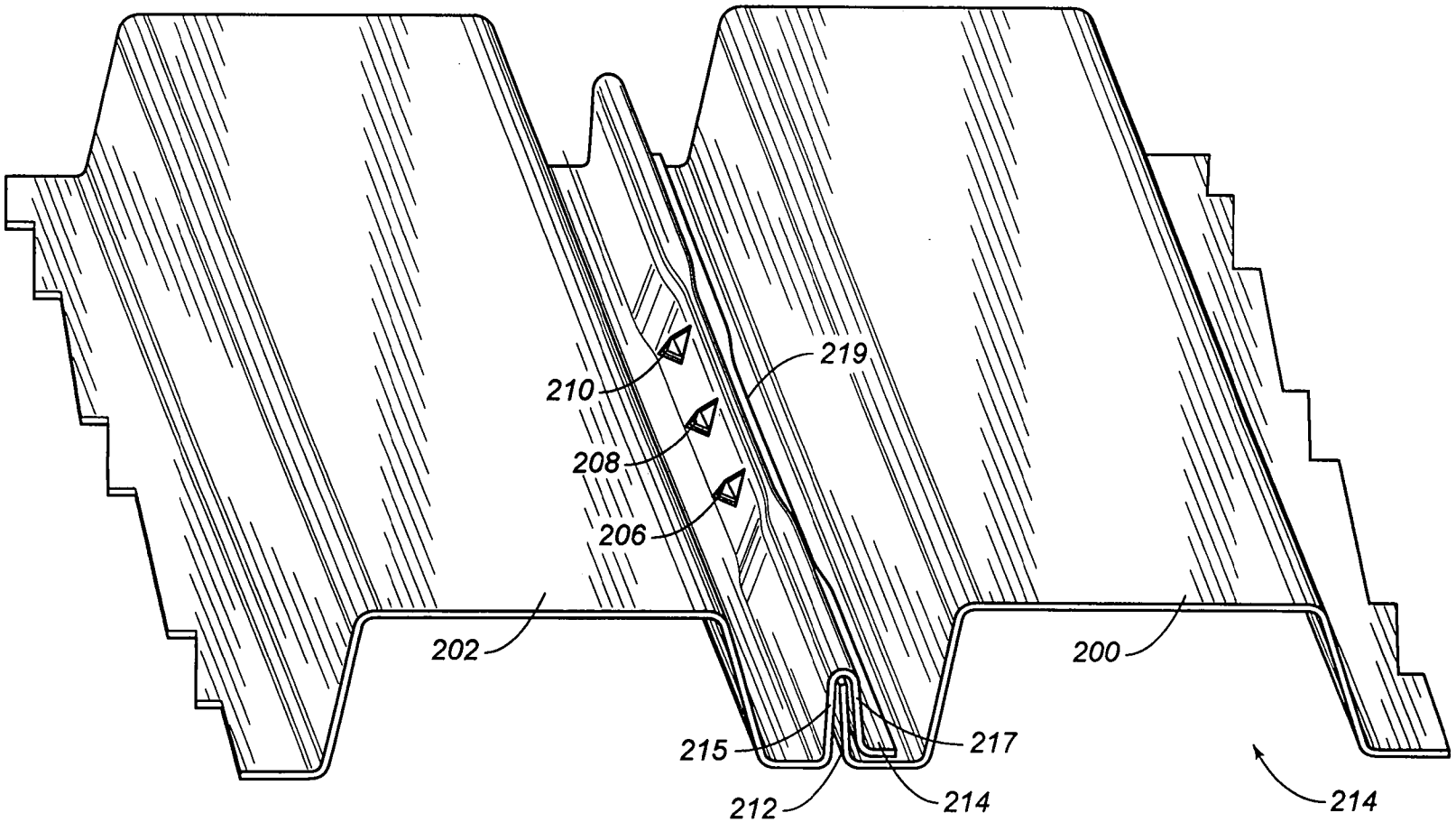
FIG. 13 is a perspective view of the cut in the adjoining sections of steel decking created by the arrangement of the male and females dies associated with the present invention.

FIG. 13 is an illustration of the cut made in adjoining sections 200 and 202 of steel decking 204. The relationship between the male die 18 and the female die 16 will result in cuts 206, 208 and 210 being formed in the decking 204. In particular, the steel deck section 200 has an upwardly extending lip 212. Similarly, deck section 202 will have an inverted U-shaped section 214. The upward turned lip 212 will be received within the interior of the inverted U-shaped section 214 so that the deck sections 200 and 202 are loosely connected together. When the punch tool 10 of the present invention is suitably actuated, the punches 206, 208 and 210 are suitably formed. The punches 206, 208 and 210 will assure a proper connection between the deck sections 200 and 202. The formation of these triangular-shaped cuts associated with punches 206,208 and 210 will prevent any lateral shifting of the sections 200 and 202 with respect to each other. Also, the punches 206, 208 and 210 will establish a suitable connection to prevent the sections 200 and 202 from pulling away from each other.

Unlike the prior art, the triangular-shaped punches 206, 208 and 210 provide a wide-area punch. As such, a dulling of blades will not present a significant problem to the formation of the suitable punches. These punches are made with the punch tool 10 of the present invention without the need for high-precision tolerances between the male and female dies. If either of the dies should become dulled with use, the punches 206, 208 and 210 can still be formed provided that suitable pressure is applied to the punch arm by the actuator. By avoiding two pivoting arms, the precise punching relationship between the arms can be minimized. Since the wearing of the pivotal connections will only occur with respect to a single arm, maintenance of the present invention will be less than that associated with a pair of pivotable arms. The minimizing of the linkages results in less cost and in greater precision in the manufacturing of the punch tool 10. It is believed that the minimization of linkages involved in the movement of the punch arm will give greater longevity and reliability to the punch tool and in the formation of the punches.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A punching tool comprising:

a frame;

a first die fixedly and non-pivotally supported by said frame, said first die comprising a plurality of female dies arranged in spaced linear alignment and extending transverse to a longitudinal axis of said frame;

a punch arm pivotally mounted on said frame;

a mating second die affixed to said punch arm, said punch arm movable between a first position in which said second die engages said first die and a second position in which said second die is spaced from said first die, said second die comprising a plurality of male dies arranged in spaced linear alignment in correspondence with said plurality of female dies; and an actuation means interconnected to said punch arm for moving said second punch arm in a scissoring action with respect to said frame so as to move said second die between said first and second positions, said actuation means comprising a piston-and-cylinder assembly with a piston rod extending therefrom, said piston rod having an end opposite said piston-and-cylinder assembly pivotally connected to an end of said punch arm opposite said second die, said piston rod extending across said frame.

2. The tool of claim 1, each of said plurality of male dies having a generally triangular cross section, each of said plurality of female dies having a generally inverted V-shaped configuration.

* * * * *